US008245793B2

(12) United States Patent
Trinh et al.

(10) Patent No.: US 8,245,793 B2
(45) Date of Patent: Aug. 21, 2012

(54) APPARATUS AND METHOD FOR DETERMINING CORRECTED WEIGHT-ON-BIT

(75) Inventors: Tu Tien Trinh, Houston, TX (US); Eric Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 321 days.

(21) Appl. No.: 12/488,357

(22) Filed: Jun. 19, 2009

(65) Prior Publication Data

US 2010/0319992 A1 Dec. 23, 2010

(51) Int. Cl.
*E21B 47/00* (2012.01)
*E21B 47/01* (2012.01)

(52) U.S. Cl. ..... 175/40; 166/250.01

(58) Field of Classification Search ..... 166/250.01, 166/66; 175/40; 73/152.48, 152.49
See application file for complete search history.

(56) References Cited

U.S. PATENT DOCUMENTS

| | | | | |
|---|---|---|---|---|
| 3,411,361 | A | 11/1968 | McLellan | |
| 3,968,473 | A | 7/1976 | Patton et al. | |
| 4,608,861 | A | 9/1986 | Wachtler et al. | |
| 4,821,563 | A * | 4/1989 | Maron | 73/152.48 |
| 4,941,951 | A * | 7/1990 | Sheppard et al. | 175/48 |
| 5,144,589 | A | 9/1992 | Hardage | |
| 5,386,724 | A * | 2/1995 | Das et al. | 73/152.59 |
| 5,415,030 | A | 5/1995 | Jogi et al. | |
| 5,448,227 | A | 9/1995 | Orban et al. | |
| 5,475,309 | A | 12/1995 | Hong et al. | |
| 5,720,355 | A | 2/1998 | Lamine et al. | |
| 5,813,480 | A * | 9/1998 | Zaleski et al. | 175/40 |
| 6,057,784 | A | 5/2000 | Schaaf et al. | |
| 6,150,822 | A | 11/2000 | Hong et al. | |
| 6,230,822 | B1 | 5/2001 | Sullivan et al. | |
| 6,419,032 | B1 | 7/2002 | Sullivan et al. | |
| 6,429,431 | B1 | 8/2002 | Wilk | |
| 6,510,389 | B1 | 1/2003 | Winkler et al. | |
| 6,540,033 | B1 | 4/2003 | Sullivan et al. | |
| 6,543,312 | B2 | 4/2003 | Sullivan et al. | |
| 6,564,883 | B2 | 5/2003 | Fredericks et al. | |
| 6,571,886 | B1 | 6/2003 | Sullivan et al. | |
| 6,626,251 | B1 | 9/2003 | Sullivan et al. | |
| 6,769,497 | B2 | 8/2004 | Dubinsky et al. | |
| 6,796,746 | B2 | 9/2004 | Jessmore et al. | |
| 6,850,068 | B2 | 2/2005 | Chemali et al. | |

(Continued)

FOREIGN PATENT DOCUMENTS

EP 0054475 A1 6/1982

(Continued)

OTHER PUBLICATIONS

Dateline Los Almos, a Monthly Publication of Los Almos National Laboratory, January Issue 1997, pp. 1-8.

(Continued)

*Primary Examiner* — William P Neuder
*Assistant Examiner* — Robert E Fuller
(74) *Attorney, Agent, or Firm* — Cantor Colburn LLP

(57) ABSTRACT

In one aspect, a method of determining a corrected weight-on-bit is provided, which method, in one embodiment, may include: drilling a wellbore with the drill bit; determining a weight-on-bit while drilling the wellbore; determining a pressure differential across an effective area of the drill bit while drilling the wellbore; and determining the corrected weight-on-bit from the determined weight-on-bit and the determined pressure differential.

15 Claims, 5 Drawing Sheets

U.S. PATENT DOCUMENTS

| | | | | |
|---|---|---|---|---|
| 7,046,165 | B2 | 5/2006 | Beique et al. | |
| 7,058,512 | B2 | 6/2006 | Downton | |
| 7,066,280 | B2 | 6/2006 | Sullivan et al. | |
| 7,143,844 | B2 | 12/2006 | Alft et al. | |
| 7,172,037 | B2 | 2/2007 | Dashevskiy et al. | |
| 7,207,215 | B2 | 4/2007 | Spross et al. | |
| 7,278,499 | B2 | 10/2007 | Richert et al. | |
| 7,308,937 | B2 | 12/2007 | Radford et al. | |
| 7,350,568 | B2 | 4/2008 | Mandal et al. | |
| 7,387,177 | B2 | 6/2008 | Zahradnik et al. | |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 2001/0054514 | A1 | 12/2001 | Sullivan et al. | |
| 2004/0069539 | A1 | 4/2004 | Sullivan et al. | |
| 2004/0222018 | A1 | 11/2004 | Sullivan et al. | |
| 2005/0161258 | A1 | 7/2005 | Lockerd, Sr. et al. | |
| 2005/0200498 | A1 | 9/2005 | Gleitman | |
| 2006/0065395 | A1* | 3/2006 | Snell | 166/255.2 |
| 2006/0175057 | A1 | 8/2006 | Mandal et al. | |
| 2007/0105339 | A1 | 5/2007 | Faris | |
| 2007/0114062 | A1 | 5/2007 | Hall et al. | |
| 2007/0186639 | A1 | 8/2007 | Spross et al. | |
| 2007/0272442 | A1 | 11/2007 | Pastusek et al. | |
| 2008/0060848 | A1 | 3/2008 | Pastusek et al. | |
| 2008/0065331 | A1 | 3/2008 | Pastusek et al. | |
| 2008/0066959 | A1 | 3/2008 | Pastusek et al. | |

FOREIGN PATENT DOCUMENTS

| | | | |
|---|---|---|---|
| EP | 0386810 | A2 | 9/1990 |

OTHER PUBLICATIONS

Semiconductor-Based Radiation Detectors, http://sensors.lbl.gov/sn_semi.html, pp. 1-5.

NETL: Oil & Natural Gas Projects, Harsh-Environment Solid-State Gamma Detector for Down-hole Gas and Oil Exploration, http://www.netl.doe.gov/technologies/oil-gas/NaturalGas/Projects_n/...., pp. 1-5.

XRF Corporation, About CZT Detectors, http://xrfcorp.com/technology/about_czt_detectors.html, 1 sheet.

International Preliminary Report on Patentability for International Application No. PCT/US2010/039136.

Schultz, Roger L. et al.; "Oilwell Drillbit Failure Detection Using Remote Acoustic Sensing," Proceeding of the America Control Conference, Anchorage, AK May 8-10, 2002, pp. 2603-2608.

* cited by examiner

APPARATUS AND METHOD FOR DETERMINING CORRECTED WEIGHT-ON-BIT

BACKGROUND INFORMATION

1. Field of the Disclosure

This disclosure relates generally to drill bits that include sensors for providing measurements relating to downhole parameters, methods of making such drill bits and drilling systems for using such drill bits.

2. Brief Description of the Related Art

Oil wells (wellbores) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations (drilling parameters), behavior of the BHA (BHA parameters) and formation surrounding the wellbore being drilled (formation parameters). To drill the wellbore, fluid pumps are turned on to supply drilling fluid or mud to the drill string, which fluid passes through a passage in the drill bit to the bottom of the wellbore and circulates to the surface via the annulus between the drill string and the wellbore wall. When the mud pump is on, the pressure inside the drill bit is greater than the pressure on the outside of the drill bit, thereby creating a pressure differential across the drill bit body. This pressure differential causes the drill bit body to act as a pressure vessel, affecting the measurements made by the weight-on-bit sensors in the drill bit. Therefore, there is a need for an improved drill bit and a method that corrects for the change in the weight and torque measurements caused by the differential pressure in the drill bit.

SUMMARY OF THE DISCLOSURE

In one aspect a method for determining a corrected weight-on-bit during drilling of a wellbore is provided, which, in one embodiment, may include: determining a first weight-on-bit with a fluid flowing through the drill bit and no applied weight-on-bit using a sensor in the drill bit; determining a second weight-on-bit with the sensor in the drill bit while drilling the wellbore using the drill bit; and determining the corrected weight-on-bit from the determined first weight-on-bit and the second-weight-on bit.

In another aspect, another method of determining a corrected weight-on-bit is provided, which method, in one embodiment, may include: drilling a wellbore with the drill bit; determining a weight-on-bit while drilling the wellbore; determining a pressure differential across an effective area of the drill bit while drilling the wellbore; and determining the corrected weight-on-bit from the determined weight-on-bit and the determined pressure differential.

In another aspect, a drill bit is disclosed that, in one embodiment, may include: a sensor in the drill bit for determining a weight-on-bit; and a processor configured to determine: a first weight-on-bit using the measurements made by the sensor with a fluid flowing through the drill bit and no weight applied to the drill bit; a second weight-on-bit using measurements from the sensor while drilling the wellbore using the drill bit; and a corrected weight-on-bit from the determined first weight-on-bit and the second-weight-on bit.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DETAILED DESCRIPTION OF THE DRAWINGS

Figure 1:
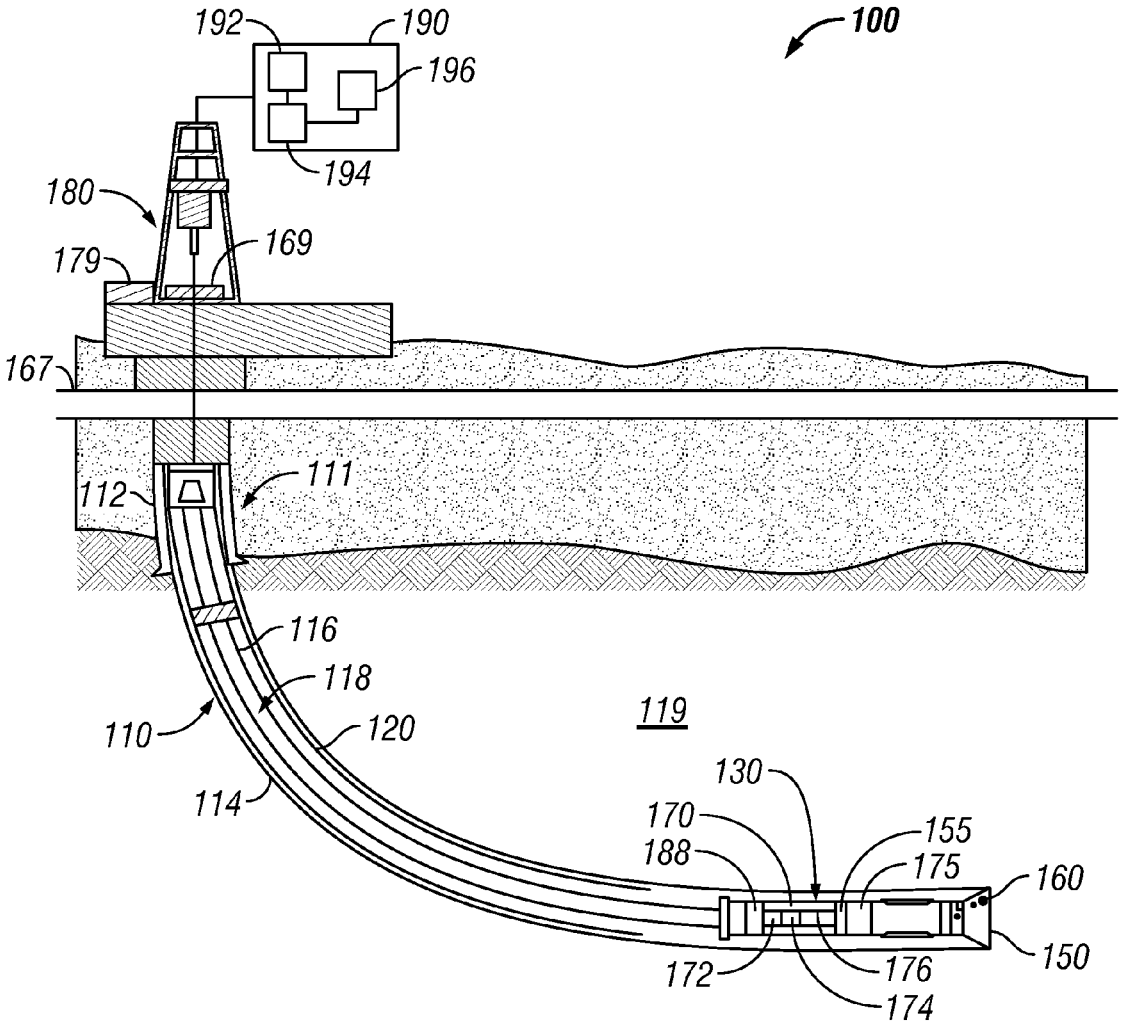
FIG. 1 is a schematic diagram of an exemplary drilling system that includes a drill bit, made according to one embodiment of the disclosure, at the bottom end of a drill string conveyed into a wellbore.

FIG. 1 is a schematic diagram of an exemplary drilling system 100 that may utilize drill bits disclosed herein for drilling a wellbore and for providing information relating to one or more parameters during drilling of the wellbore. System 100 shows a wellbore 110 that includes an upper section 111 with a casing 112 installed therein and a lower section 114 being drilled with a drill string 118. The drill string 118 includes a tubular member 116 that carries a drilling assembly 130 (also referred to as the bottomhole assembly or "BHA") at its bottom end. The tubular member 116 may be made up by joining drill pipe sections or it may be coiled tubing. A drill bit 150 is attached to the bottom end of the BHA 130 for disintegrating the rock formation to drill the wellbore 112 of a selected diameter in the formation 119. The terms wellbore and borehole are used herein as synonyms.

The drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with offshore rigs used for drilling wellbores. A rotary table 169 or a top drive (not shown) coupled to the drill string 118 may be utilized to rotate the drill string 118 at the surface to rotate the drilling assembly 130 and thus the drill bit 150 to drill the wellbore 110. A drilling motor 155 (also referred to as "mud motor") may also be provided to rotate the drill bit. A control unit (or controller) 190, which may be a computer-based unit, may be placed at the surface 167 for receiving and processing data transmitted by the sensors in the drill bit and other sensors in the drilling assembly 130 and for controlling selected operations of the various devices and sensors in the drilling assembly 130. The surface controller 190, in one embodiment, may include a processor 192, a data storage device (or a computer-readable medium) 194 for storing data and computer programs 196. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall of the wellbore 110.

Still referring to FIG. 1, the drill bit 150 includes one or more sensors 160 and related circuitry for estimating one or more parameters relating to the drill bit 150 and drilling assembly 130 as described in more detail in reference to FIGS. 2-7. The drilling assembly 130 may further include one or more downhole sensors (also referred to as the measurement-while-drilling (MWD) sensors or logging-while-drilling (LWD) sensors, collectively designated by numeral 175, and at least one control unit (or controller) 170 for processing data received from the MWD or LWD sensors 175 and the drill bit 150. The controller 170 may include a processor 172, such as a microprocessor, one or more data storage devices 174 and one or more programs 176 for use by the processor to process downhole data and to communicate data with the surface controller 190 via a two-way telemetry unit 188. The data storage devices 174 may include any suitable memory devices, including, but not limited to, a read-only memory (ROM), random access memory (RAM), flash memory and disk.

Figure 2:
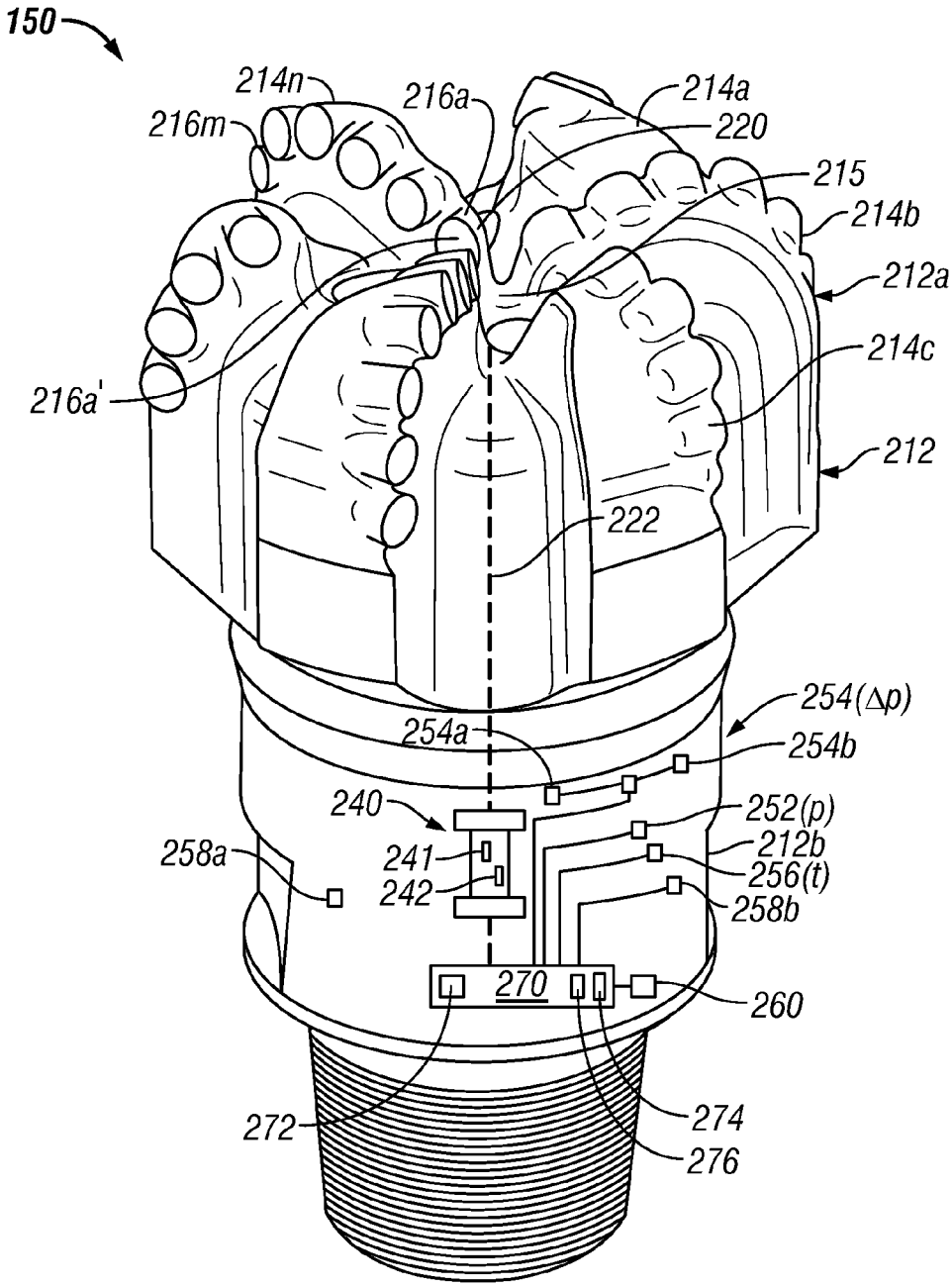
FIG. 2 is an isometric view of an exemplary drill bit made according to one embodiment of the disclosure.

FIG. 2 is an isometric view of an exemplary drill bit 150 showing a number of sensors, including a weight sensor, a torque sensor, accelerometers, a temperature sensor, a pressure sensor and a differential pressure sensor, and a control module containing electronic circuitry configured to process information from the various sensors and to provide estimates of corrected weight-on-bit and torque-on-bit during drilling of a wellbore. The drill bit 150 shown is a polycrystalline diamond compact (PDC) drill bit for explanation purposes only. The disclosure herein equally applies to other types of drill bits. The drill bit 150 is shown to include a drill bit body 212 comprising a crown 212*a* and a shank 212*b*. The crown includes a number of blade profiles (also referred to herein as "profiles") 214*a*, 214*b*, . . . 214*n*. A number of cutters are placed along each profile. For example, blade profile 214*n* is shown to contain cutters 216*a*-216*m*. All profiles are shown to terminate at the bottom of the drill bit 215. Each cutter has a cutting surface, such as cutting surface 216*a*' of cutter 216*a*, that engages the rock formation when the drill bit 150 is rotated during drilling of the wellbore. Each cutter 216*a*-216*m* has a back rake angle and a side rake angle that in combination define the depth of cut of that cutter.

Still referring to FIG. 2, the drill, in one aspect, may include a sensor package 240 that may include a weight sensor 241 and a torque sensor 242, which package may be placed at any suitable location in the bit body. In another aspect, separate weight and torque sensors may be placed in the drill bit 150. In another aspect, a pressure sensor 252 may be placed in an internal section of the drill bit 150 to provide signals corresponding to the pressure of the fluid inside the drill bit 150. Alternatively, a differential pressure sensor 254 may be placed in the drill bit 150 with a first sensor element 254*a* for measuring pressure inside the drill bit and a second sensor element 254*b* for measuring the pressure on the outside of the drill bit 150. The pressure sensor 252 and the differential pressure sensor 254 may be placed in the shank 212*b* or at any other suitable location. In another aspect, a temperature sensor 256, exposed to the fluid downhole, may be provided to measure the temperature downhole. In yet another aspect, one or more accelerometers, such as accelerometers 258*a* and 258*b* may be provided to determine the acceleration of the drill bit 150. Measurements from two accelerometers or more sensors may be used to improve resolution of the determined acceleration. A control module 270 (also referred to herein as the "electronic module" or "electronic circuitry") may be provided at any suitable location in the drill bit 150. The electronic module 270 may include a processor 272, such as a microprocessor, configured to process signals from the various sensors and provide results relating to the weight-on-bit and torque-on-bit as described in more detail in reference to FIGS. 4-7. The electronic module 270 may store information and calculated results in a memory 274 contained in the module 270 and/or transmit such information and results to the controller 170 in the drilling assembly 130 via a data communication module 260 in the drill bit 150. The processor 272 is configured to execute instructions contained in one or more programs 276 stored in the memory 272.

Figure 3:
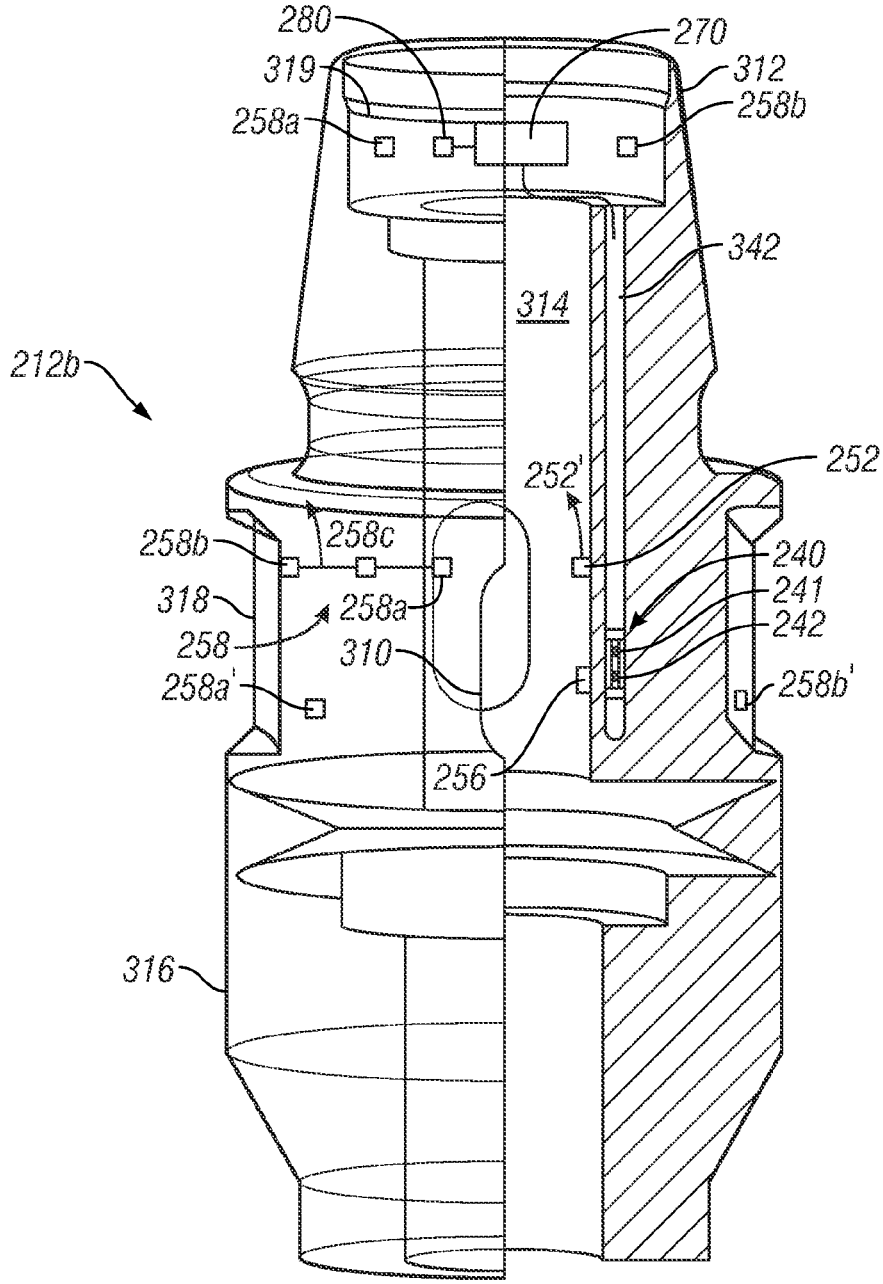
FIG. 3 is a transparent isometric view of a portion of the drill bit showing placement of certain sensors and a control unit therein according to one embodiment of the disclosure.

FIG. 3 is a schematic diagram of shank 212*b* showing placement of the sensors described in reference to FIG. 2, according to one embodiment. In one aspect, shank 212*b* includes a neck section 312 having a bore 314 therethrough for the passage of the drilling fluid. The control module 270, in one aspect, may be placed in a sealed package 319 in the neck section 312 so that the control module 270 remains substantially at the surface pressure. The pressure sensor 252 may be placed along the bore section 314 and coupled to the electronic module 270 via a conductor 252' running through the shank body 318. The pressure sensor 252 may be placed at any other location, such as inside the neck. The pressure differential sensor 254 may be placed in the shank body 318 with one sensing element 254*a* along the inside of the passage 314 and the other sensing element 254*b* along the outside of the shank body 318. The differential pressure sensor 354 may be coupled to the control unit 270 by a suitable conductor 258*c*. As noted above, one or more accelerometers may be placed in the bit body. FIG. 3 shows a pair of accelerometers 258*a* and 258*b* in the neck section, proximate the control module 270. The accelerometers may be placed at any other suitable location in the bit, including the location of accelerometers 258*a*' and 258*b*' shown in FIG. 3. The measurements from accelerometers placed radially opposite may be added to improve accuracy of the accelerometer measurements. Any other placement or arrangement of two or more accelerometers may also be utilized for the purpose of this disclosure. A temperature sensor 256 may be placed at any suitable location, such as inside the passage 314. In an aspect, the sensor package 240 may be placed in a passage 342 formed in a wall of the shank 212*b*. In another aspect, a data communication unit 280 may be provided in the drill bit near the neck section 312 for two-way data communication between the control module 270 and the controller 170 in the drilling assembly 130 (FIG. 1). A power source 285, such as a battery pack, provides power to the control unit 270 and the various sensors in the drill bit 150. The methods of determining corrected or compensated weight-on-bit during drilling of a wellbore are described in reference to FIGS. 4-6.

Figure 4:
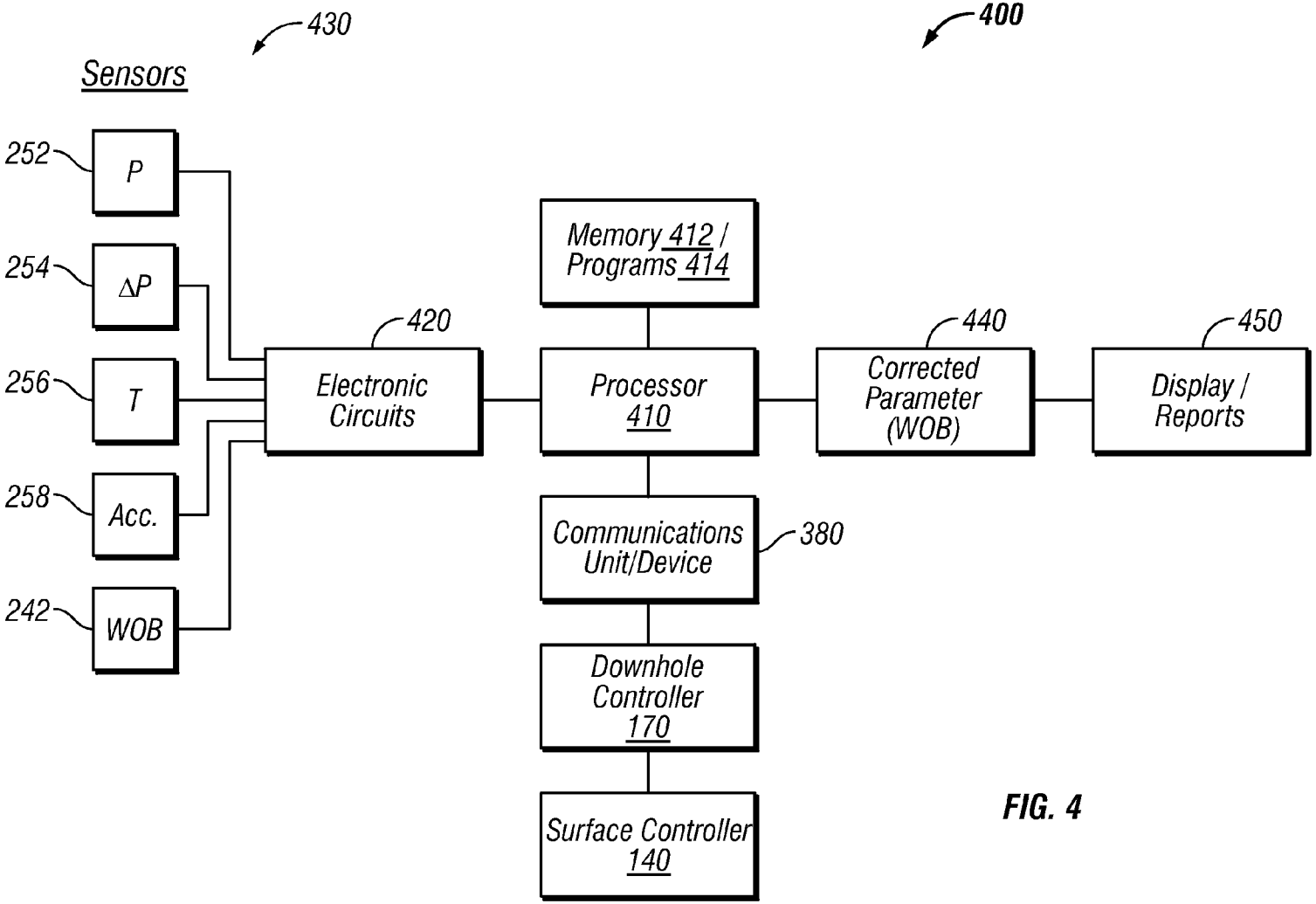
FIG. 4 is a functional diagram showing a control circuit configured to process information from the sensors in the drill bit and provide certain results therefrom, according to one embodiment of the disclosure.

FIG. 4 is a functional diagram showing a control system 400 configured to process information from the various sensors in the drill bit 150 and to provide estimates of the weight-on-bit, corrected for the effect of the drilling fluid pressure on the drill bit during drilling of a wellbore. The control system 400 includes a processor 410, such as a microprocessor, and an electronic signal processing and conditioning unit 420. The signals from the various sensors 430, which may include a pressure sensor 252, a differential pressure sensor 254, a temperature sensor 256, one or more accelerometers 258, and a weight-on-bit ("WOB") sensor 242, are fed to the electronic signal processing and conditioning unit 420, which provides digital output signals corresponding to the sensor measurements. The processor 410 is configured to process the sensor signals in accordance with the instructions contained in the computer program 414 stored in a data storage device 412 and to provide the weight-on-bit and torque-on-bit values as the outputs. The processor 410 may send the computed values of the WOB and torque-on-bit to the control unit 170 via the communication unit 380, which may utilize any suitable telemetry method, including, but not limited to, electrical coupling, acoustic telemetry and electromagnetic telemetry. The controller 170 may further process the received information and/or send the received information from the processor 410 to the surface controller 140 (FIG. 1).

Figure 5:
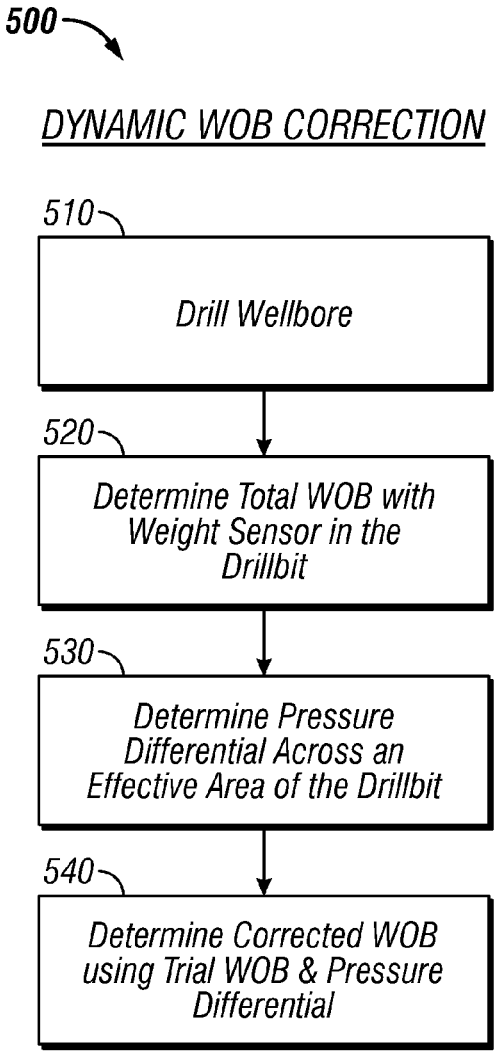
FIG. 5 is a flow diagram depicting a method of determining the corrected weight-on-bit utilizing a dynamic weight-on-bit offset, according to another aspect of the disclosure.

FIG. 5 is a flow diagram 500 depicting a method of calculating a dynamic corrected weight-on-bit (WOBc) using in-situ pressure differential 254 across an effective area "A" (FIGS. 2 and 3) of the drill bit and the total weight-on-bit (WOBt) using a weight-on-bit sensor 241 (FIGS. 2 and 3) in the drill bit, while drilling the wellbore. In one embodiment of the method, the pumps are turned on and a selected weight is applied on the drill bit to drill the wellbore (Block 510). A pressure differential (Dp) across an effective area "A" of the drill bit is measured, while drilling the wellbore (Block 520). The measured pressure differential may be converted into an equivalent offset weight-on-bit WOBo. The WOBo provides a dynamic or instantaneous offset value for the weight-on-bit caused by the pressure differential across the effective drill bit area "A". The WOBo is a dynamic value because it changes as the pressure differential across the effective are "A" changes. The effective area "A", in one aspect, may be across the shank of the drill bit. The total weight WOBt may be measured from the weight-on-bit sensor 241, contemporaneously (substantially at the same time as the pressure differential is measured) (Block 530). The total weight-on-bit WOBt includes the effect of the weight-on-bit caused by the pressure differential Dp. The corrected weight on bit WOBc may then be determined from the WOBt and WOBo as WOBc=WOBt−WOBo (Block 540).

Figure 6:
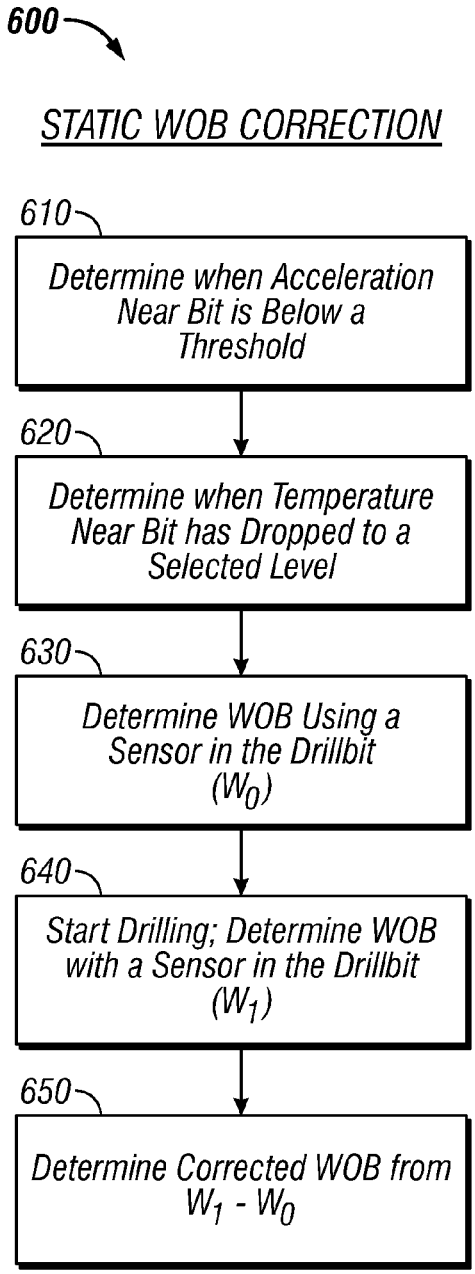
FIG. 6 is a flow diagram depicting a method of determining the corrected weight-on-bit using a static weight-on-bit offset, according to yet another aspect of the disclosure.

FIG. 6 is a flow diagram depicting a method 600 of determining the corrected weight-on-bit (WOBc) using a static weight-on-bit offset value (WOBo). The static offset value WOBo, in one aspect, may be determined when the drill bit is stationary while the drilling fluid is flowing under pressure through the drill bit, i.e., the pumps are on while no weight is applied on the drill bit. In one aspect, the static drill bit condition may be determined by measuring an acceleration or motion of the drill bit (Block 610). The acceleration or motion may by determined by using one or more accelerometers in the BHA or drill bit. A nominal value of acceleration or a value below a selected value may indicate that the drill bit is stationary. The presence of fluid flow may be determined from a temperature measurement downhole, such as by a temperature sensor in the BHA or the drill bit. The temperature of the flowing drilling fluid in the drill bit is lower compared to the temperature of the stationary fluid in the drill bit. This is because the stationary fluid heats up substantially due to high formation temperature. The temperature of the fluid in the drill bit or in the BHA may be measured by a temperature sensor in the drill bit or the BH (Block 620). When the acceleration or motion is below a selected level and the temperature is below a selected level or when a suitable temperature drop in the fluid has been observed, the controller (in the BHA, surface or in the drill bit) may activate the taking of measurements from the weight sensor in the drill bit and provide a value of a static weight-on-bit offset value WOBo (Block 630). The drilling may then be started with an applied weight-on-bit and the controller may then determine the total weight-on-bit WOBt using the sensor 241 in the drill bit (Block 640). The corrected weight-on-bit WOBc may then be determined from WOBt and WOBo as WOBc=WOBt−WOBo (Block 650).

Referring to FIGS. 1-6, in the various embodiments disclosed herein, the processor in the drill may transmit the weight on the drill bit information to the controller 170 in the drilling assembly 130 and or the surface controller 190. The driller at the surface, downhole controller, surface controller 190 or any combination thereof may take one or more actions in response the determined weight on the drill bit. Such actions may include, but are not limited to, altering: the weight on the drill bit, rotational speed of the drill bit, pressure of the circulating drilling fluid and drilling direction to more efficiently perform the drilling and to extend the life of the drill bit 150 and/or BHA. The sensor signals or the computed values of the weight-on-bit and torque-on-bit determined by the downhole controller 170 or 270 may be sent to the surface controller 190 for further processing. In one aspect, the surface controller 190 may utilize any such information to effect one or more changes in the drilling operations, including, but not limited to, altering weight-on-bit, rotational speed of the drill bit, and the rate of the fluid flow so as to increase the efficiency of the drilling operations and extend the life of the drill bit 150 and drilling assembly 130. In another aspect, the weight and torque values may be presented (such as in a visual format) to an operator so that the operator may take appropriate actions.

Thus, in one aspect, a method of determining a corrected weight-on-bit during drilling of a wellbore is provided, which in one embodiment may include: determining a first weight-on-bit with a fluid flowing through the drill bit and no applied weight-on-bit using a sensor in the drill bit; determining a second weight-on-bit with the sensor in the drill bit while drilling the wellbore using the drill bit; and determining the corrected weight-on-bit from the determined first weight-on-bit and the second-weight-on bit. In one aspect, the corrected weight-on-bit may be determined by subtracting the first determined weight-on-bit from the second determined weight-on-bit. In one aspect, the corrected weight-on-bit may determined by processing signals from the sensor by a processor in the drill bit, a processor in a BHA attached to the drill bit and/or by a processor at the surface. In one aspect, the first weight-on-bit may be determined by: determining a temperature of the fluid flowing through the drill bit; determining acceleration of the drill bit; and processing signals from the sensor in the drill to determine the first weight-on-bit when the determined temperature meets a selected criterion and the determined acceleration meets a selected criterion. The temperature may be determined using a temperature sensor in the drill bit and the acceleration may be determined using an accelerometer in the drill bit.

In another aspect, a drill bit is provided that, in one embodiment may, include: a sensor in the drill bit for determining a weight-on-bit; and a processor configured to determine: a first weight-on-bit using the measurements made by the sensor with a fluid flowing through the drill bit and no weight applied to the drill bit; a second weight-on-bit using measurements from the sensor while drilling the wellbore using the drill bit; and a corrected weight-on-bit from the determined first weight-on-bit and the second-weight-on bit. In one aspect, the sensor may be disposed in a shank of the drill bit. In another aspect, the processor may be configured to determine the corrected weight-on-bit by subtracting the first-weight-on-bit from the second-weight-on-bit. In another aspect, the processor may be enclosed in a module in the drill bit at atmospheric pressure. In another aspect, the drill bit may include a data communication device coupled to the processor and configured to transmit data from the drill bit to a location outside the drill bit.

In yet anther aspect, another method for determining a corrected weight-on-bit is provided, which in one embodiment may include: drilling a wellbore with the drill bit; determining a weight-on-bit while drilling the wellbore; determining a pressure differential across an effective area of the drill bit while drilling the wellbore; and determining the corrected weight-on-bit from the determined weight-on-bit and the determined pressure differential. In one aspect, the pressure differential may be determined by measuring the pressure differential between a pressure inside the drill bit and a pressure outside the drill bit. A differential pressure sensor having a first sensing element for sensing pressure inside the drill bit and a second sensing element for sensing the pressure outside the drill bit may be utilized to determine the pressure differential. The first and second sensing elements may be disposed in a shank of the drill bit. In one aspect, the corrected weight-on-bit may be determined by processing signals from a weight-on-bit sensor and signals from a differential pressure sensor by a processor that is located inside the drill bit, in the BHA, at the surface or a combination thereof.

In yet another aspect, an apparatus for use in drilling a wellbore is provided that in one embodiment may include; a drill bit body having a fluid passage therethrough; a first sensor in the drill bit configured to measure weight-on-bit; a second sensor in the drill bit body configured to measure pressure differential across an effective area of the drill bit; and a processor configured to determine a first weight-on-bit from the measurements of the first sensor, a second weight-on-bit from the measurements of the pressure differential, and the corrected weight-on-bit using the determined first weight-on-bit and the second weight-on-bit. The second sensor may comprise a first sensing element configured to measure pressure inside the drill and a second sensing element configured to measure pressure outside the drill bit. The apparatus may further include a memory for storing the corrected weight-on-bit. A communication device in the drill bit may be configured to transmit data from the drill bit to a location outside the drill bit. The processor may be placed inside the drill bit or outside the drill bit.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. A method of determining a corrected weight on a drill bit (weight-on-bit) during drilling of a wellbore, comprising:

measuring a first weight-on-bit while a fluid flows through the drill and no applied weight-on-bit using a sensor on a sensor package in the drill bit, wherein the sensor package includes a member bound by end sections that have a larger transverse dimension than the member, wherein the member is located within a passage that is separate from a flow path for drilling fluid;

measuring a second weight-on-bit with the sensor in the drill bit while drilling the wellbore using the drill bit; and determining the corrected weight-on-bit from the first weight-on-bit and the second weight-on bit.

2. The method of claim 1, wherein the corrected weight-on-bit is determined by subtracting the first weight-on-bit from the second weight-on-bit.

3. The method of claim 1, wherein the corrected weight-on-bit is determined by one of: processing signals from the sensor downhole or on the surface.

4. The method of claim 1, wherein measuring the first weight-on-bit comprises:

determining a temperature of the fluid flowing through drill bit;

determining acceleration of the drill bit; and processing signals from the sensor in the drill to measure the first weight-on-bit when the determined temperature meets a selected criterion and the determined acceleration meets a selected criterion.

5. The method of claim 4 further comprising:

determining the temperature using a temperature sensor in the drill bit; and determining the acceleration using an accelerometer in the drill bit.

6. The method of claim 1 further comprising determining a pressure differential across an effective area of the drill bit while drilling the wellbore, wherein determining the corrected weight-on-bit comprises determining the corrected weight-on-bit from the first weight-on-bit, the second weight-on bit and the determined pressure differential.

7. The method of claim 6, wherein determining the pressure differential comprises determining pressure differential between a pressure inside the drill bit and a pressure outside the drill bit.

8. The method of claim 6, wherein determining the pressure differential comprises using a sensor having a first sensing element sensing pressure at the inside of the drill bit and a second sensing element sensing pressure at the outside the drill bit.

9. A drill bit comprising:

a first sensor in the drill bit for measuring a weight-on-bit, wherein the sensor is positioned on a sensor package that includes a member bound by end sections that have a larger transverse dimension than the member, wherein the member is located within a passage that is separate from a flow path for drilling fluid; and a processor configured to:

measure a first weight-on-bit using the measurements made by the first sensor with a fluid flowing through the drill bit and no weight applied to the drill bit;

measure a second weight-on-bit using measurements from the first sensor while drilling the wellbore using the drill bit; and determine a corrected weight-on-bit from the first weight-on-bit and the second weight-on bit.

10. The drill bit of claim 9, wherein the first sensor is disposed in a shank of the drill bit configured to measure weight-on-bit.

11. The drill bit of claim 10, wherein the processor is configured to determine the corrected weight-on-bit by subtracting the first weight on-bit from the second weight-on-bit.

12. The drill bit of claim 11, wherein the processor is enclosed in a module in the drill bit.

13. The drill bit of claim 12 further comprising a data communication device coupled to the processor and configured to transmit data from the drill bit to a location outside the drill bit.

14. The drill bit of claim 9, further comprising a second sensor in the drill bit configured to measure pressure differential across an effective area of the drill bit; and a processor configured to:

determine a third weight-on-bit from the measurements of the pressure differential; and determine corrected weight-on-bit using the determined first weight-on-bit, the second weight-on-bit and the third weight-on-bit.

15. The apparatus of claim 14, wherein the second sensor comprises a first sensing element configured to measure pressure inside the drill bit and a second sensing element configured to measure pressure outside the drill bit.

* * * * *